US005255479A

United States Patent [19]

Shepherd

[11] Patent Number: 5,255,479

[45] Date of Patent: Oct. 26, 1993

[54] EMERGENCY ESCAPE HATCH

[75] Inventor: Carl H. Shepherd, 9488 River Moon Ct., Inverness, Fla. 32650

[73] Assignees: Carl H. Shepherd; Edward L. Shepherd, both of Inverness, Fla.

[21] Appl. No.: 803,427

[22] Filed: Dec. 6, 1991

[51] Int. Cl.[5] ..... E04B 2/82

[52] U.S. Cl. ..... 52/127.8; 52/208; 49/449; 49/465

[58] Field of Search ..... 52/127.1, 127.8, 125.2, 52/122.1, 204, 208; 49/465, 394, 449; 292/DIG. 31, 202, 204, 194, DIG. 68, DIG. 63, 336.3

[56] References Cited

U.S. PATENT DOCUMENTS

| | | | |
|---|---|---|---|
| 2,387,187 | 10/1945 | Smith | 292/DIG. 31 |
| 2,793,721 | 5/1957 | Sterud | 52/204 X |
| 3,490,176 | 1/1970 | Danois | 52/204 |
| 4,424,646 | 1/1984 | Adams | 49/465 X |
| 4,468,886 | 9/1984 | Tew | 52/127.8 X |
| 4,475,313 | 10/1984 | Governale | 49/449 X |
| 4,993,763 | 2/1991 | Tanimoto et al. | 292/336.3 |

*Primary Examiner*—Carl D. Friedman
*Assistant Examiner*—Kien Nguyen
*Attorney, Agent, or Firm*—Stanley M. Miller

[57] ABSTRACT

An escape hatch that is added to an occupied structure by cutting an opening in an exterior wall that is then closed with the main body of the hatch. A pair of pivotally mounted handles are provided on the interior wall of the hatch so that when both handles are pivoted, the hatch may be pushed out so that it falls onto the ground outside the structure and so that the occupants of the structure may then crawl through the opening. An exterior wall of the hatch is larger than the opening so that the hatch cannot be pushed into the interior of the structure by a person outside it. The handles are designed to be opened with minimal force and the hatch construction includes numerous features that ensure against jamming of the hatch when it needs to be opened.

11 Claims, 2 Drawing Sheets

EMERGENCY ESCAPE HATCH

BACKGROUND OF THE INVENTION

1. Field of the Invention

This invention relates, generally, to fire safety devices. More particularly, it relates to an escape hatch built into a wall of a dwelling.

2. Description of the Prior Art

The problems associated with fires in occupied dwellings have caught the attention of many inventors over the years. Numerous fire safety devices have been invented and some of them have saved lives.

One of the inventions in widespread use today is commonly known as the panic bar; it enables people who are not thinking clearly to open a door by simply pressing against the bar. The device has great utility, but it is usually installed in public buildings only. Moreover, its operation requires that the operator be standing. A person running or walking toward the door may be overcome by fumes before reaching it. Private dwellings are almost never equipped with doors having panic bars. As a result, most homes have no special means for escaping therefrom in the event of a fire. If the route to the doors of the dwelling is blocked, and if the windows cannot be broken, escape opportunities simply do not exist.

There is a need, then, for a fire escape device that can be installed in private homes. Moreover, there is a need for a device that requires its user to be in a crawling position at the time the device is used; such a feature would require the occupants of the structure to assume the crawling position during the evacuation procedure, thereby decreasing their chances of being overcome by fumes.

The prior art, when considered as a whole in accordance with the requirements of law, neither teaches nor suggests to those of ordinary skill in the art how the need that has been perceived could be fulfilled.

SUMMARY OF THE INVENTION

The present invention provides an escape hatch that is positioned in a wall of a dwelling at the lowermost end thereof so that the individuals using the hatch will be required to be in a crawling position at the time of its use. Fire escape rehearsal drills with the novel device will also train the dwelling's occupants to crawl when approaching the device.

The device includes handle means which are easily manipulated to open the hatch when needed; it is designed for facile opening even by small children or feeble individuals of any age.

Significantly, the hatch cannot be opened by anyone outside the dwelling. This feature insures that burglars will not be able to enter the dwelling through the hatch.

In a preferred embodiment, a pair of laterally spaced handles are provided on the interior wall of the hatch. The handles are pivotally mounted so that very little strength is needed to cause them to pivot. The pivoting of each handle results in retraction of an associated latch from a catch means formed in the frame of the dwelling and the hatch is constructed such that it can only fall outside the dwelling when the handles are pivoted as required. Once the hatch has fallen out of its locked position, a passageway through which the occupants of the dwelling may crawl is thereby opened.

The primary object of this invention is to save lives by providing an escape hatch that is easy and inexpensive to install in private or public dwellings or structures.

A closely related object is to provide an escape hatch that is easy to operate even by weak or weakened individuals.

Another object is to provide an escape hatch that is used by people in a crawling position so that they will be safe from fumes.

Still another object is to provide an escape hatch that can only be opened by people inside a structure.

These and other important objects, features, and advantages of the invention will become apparent as this description proceeds.

The invention accordingly comprises the features of construction, combination of elements, and arrangement of parts that will be hereinafter set forth, and the scope of the invention will be indicated in the claims.

BRIEF DESCRIPTION OF THE DRAWINGS

For a fuller understanding of the nature and objects of the invention, reference should be made to the following description, taken in connection with the accompanying drawings wherein:

FIG. 5 is an enlarged, elevational view of the novel latch plate; an

DETAILED DESCRIPTION OF THE PREFERRED EMBODIMENT

Figure 1:
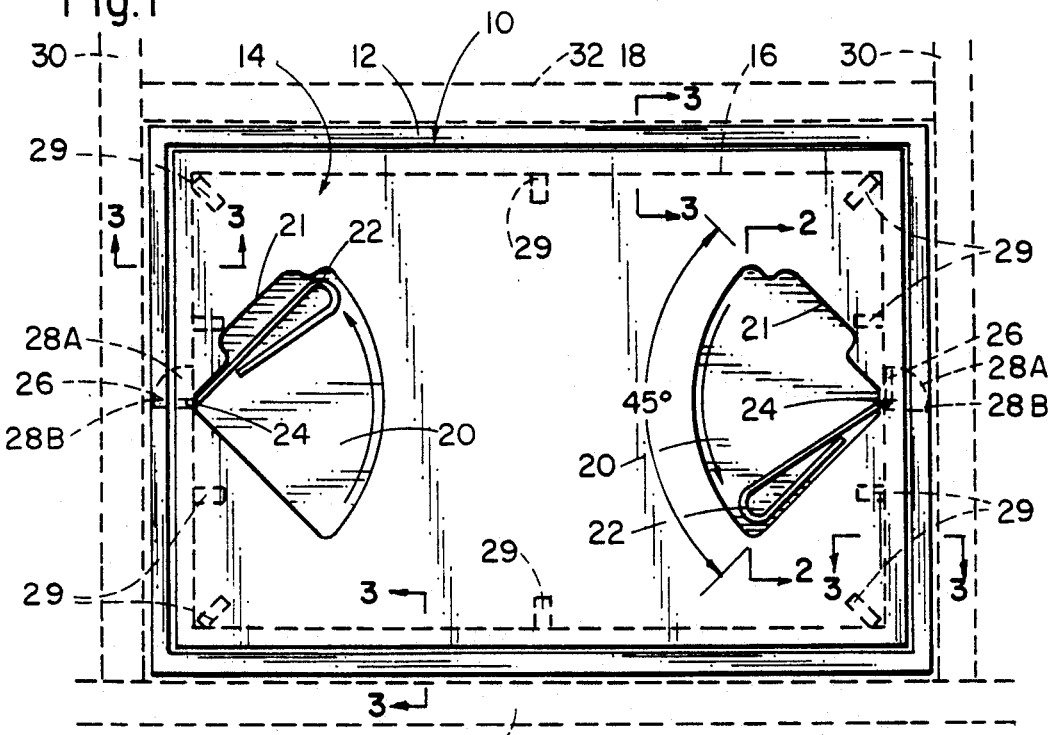
FIG. 1 is a front elevational view of a preferred embodiment of the invention.
Figure 2:
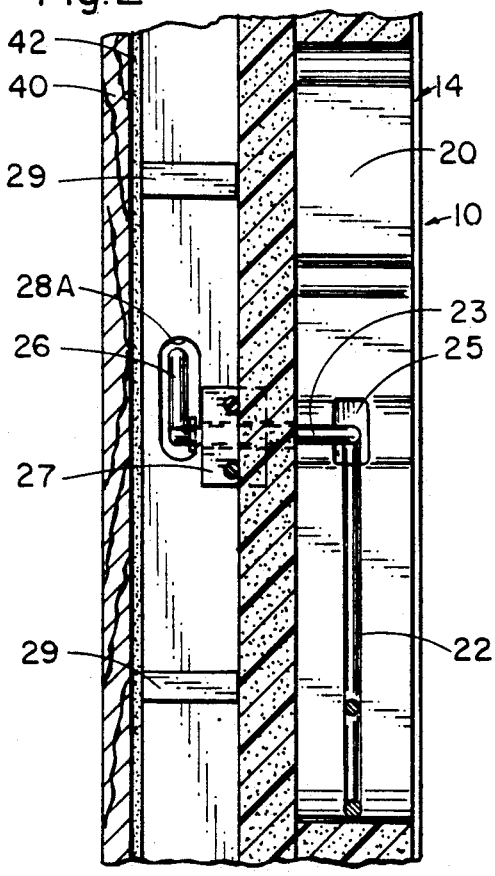
FIG. 2 is a sectional view taken along line 2—2 in FIG. 1.
Figure 3:
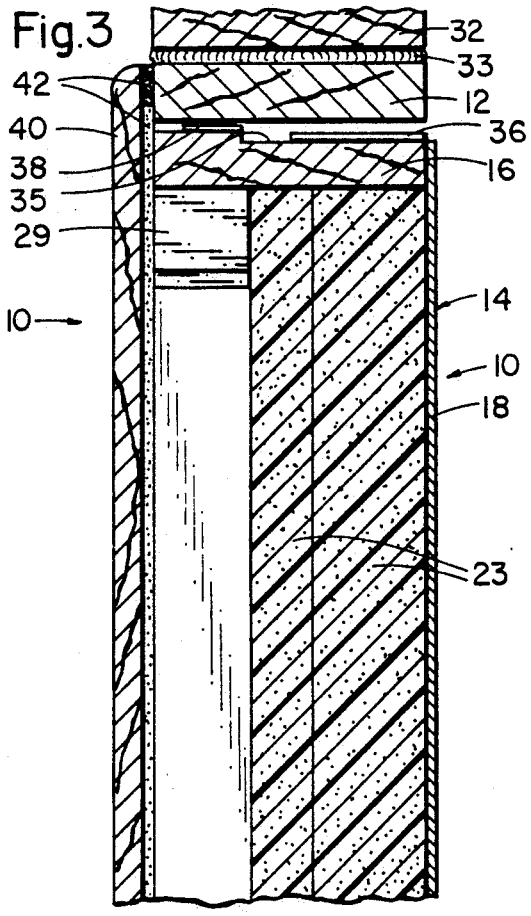
FIG. 3 is a sectional view taken along line 3—3 in FIG. 1.

Referring now to FIG. 1, it will there be seen that an exemplary embodiment of the novel hatch assembly is denoted as a whole by the reference numeral 10. Hatch assembly 10 includes a rectangular exterior frame 12 that is built into an exterior wall of the occupied structure within which the novel hatch is mounted, and a removable hatch main body 14 that will hereinafter be referred to as hatch 14. Hatch 14 is framed by a rectangular hatch frame 16 and includes a interior wall 18 which is provided in the form of a thin veneer as shown in FIG. 3. A pair of insulation sheets, collectively denoted 23, underlie veneer 18 as shown in FIG. 3 so that the dwelling continues to be insulated against heat and cold after the assembly 10 has been installed. A pair of wedge-shaped recesses, collectively denoted 20, are formed through the veneer 18 and through the sheet of insulation 23 that supports said veneer; the recesses do not penetrate the sheet of insulation 2 that underlies the veneer-supporting sheet 23, as perhaps best understood by comparing FIGS. 2 and 3. Note finger-receiving area 21 of each recess; this recess performs the function its name expresses, i.e., it enables gripping of the handles 22 when they are in the position depicted on the left side of FIG. 1.

A pivotally mounted latch handle means is positioned in each recess 20; it is made, preferably, of a quarter inch in diameter metal rod. As best shown in FIG. 2, each latch handle means includes a first part o handle 22 that is positioned within its associated recess, an axis part 24 that is bent ninety degrees relative to the handle 22 and which extends through a bore formed in insulation sheet 23, and a locking bolt part 26 that is bent ninety degrees relative to the axis part 24. Note in FIG. 1 that locking bolt 26 is disposed at a one hundred thirty five degree angle relative to handle 22. A retention plate 27 (FIG. 2) and a depression 25 (FIG. 2) maintain the axis 24 in position while allowing it to rotate when handle 22 is manipulated. The handle assembly is recessed so that the handles will not protrude into the room equipped with the novel hatch.

The recesses and hence the handles are laterally spaced apart with respect to one another in equidistantly spaced relation to a vertical centerline of the hatch main body, on opposite sides thereof; this arrangement of parts virtually assures that the hatch main body will not become cocked or jammed against the exterior frame 12 when said main body is removed, even if it is removed in great haste.

FIG. 2 also shows wooden spacers 29 that separate the interior insulated sheet 23 from the outside wall 40; the spacers are strategically positioned to support said outside wall. Wall 40 is a finished material such as pressure treated plywood or other suitable material. A sealing gasket 42, made of foam rubber weatherstripping, is preferably positioned between the spacers and the outside wall 40. A white greaseless lubricant such as powdered mica, or other suitable substance, is applied to the interior surface of the weatherstripping 42 to prevent it from sticking against frame 12. Note in FIG. 3 where the contact between weatherstripping 42 and frame 12 occurs; the need for a nonsticking, readily separable contact between said abutting parts is of course critical to the effectiveness of the novel hatch assembly. Note further that exterior wall 40 has a height and width greater then the height and width of the opening framed by frame 12; this ensures that the hatch cannot be pushed into the interior of the house by anyone positioned outside the house.

As shown in FIG. 3, the outer edge of frame 16 is cut away as at 35 to space hatch frame 16 from exterior frame 12; this spacing is also critical to ensure that hatch frame 16 can slidingly separate from exterior frame 12 in an emergency situation, i.e., the spacing prevents jamming of the two parts against one another. A plurality of Nylon strips 36 and 38 are provided along the bottom edges only of hatch frame 16 to further facilitate sliding removal of hatch 14 and its frame 16 from frame 12.

Figure 4:
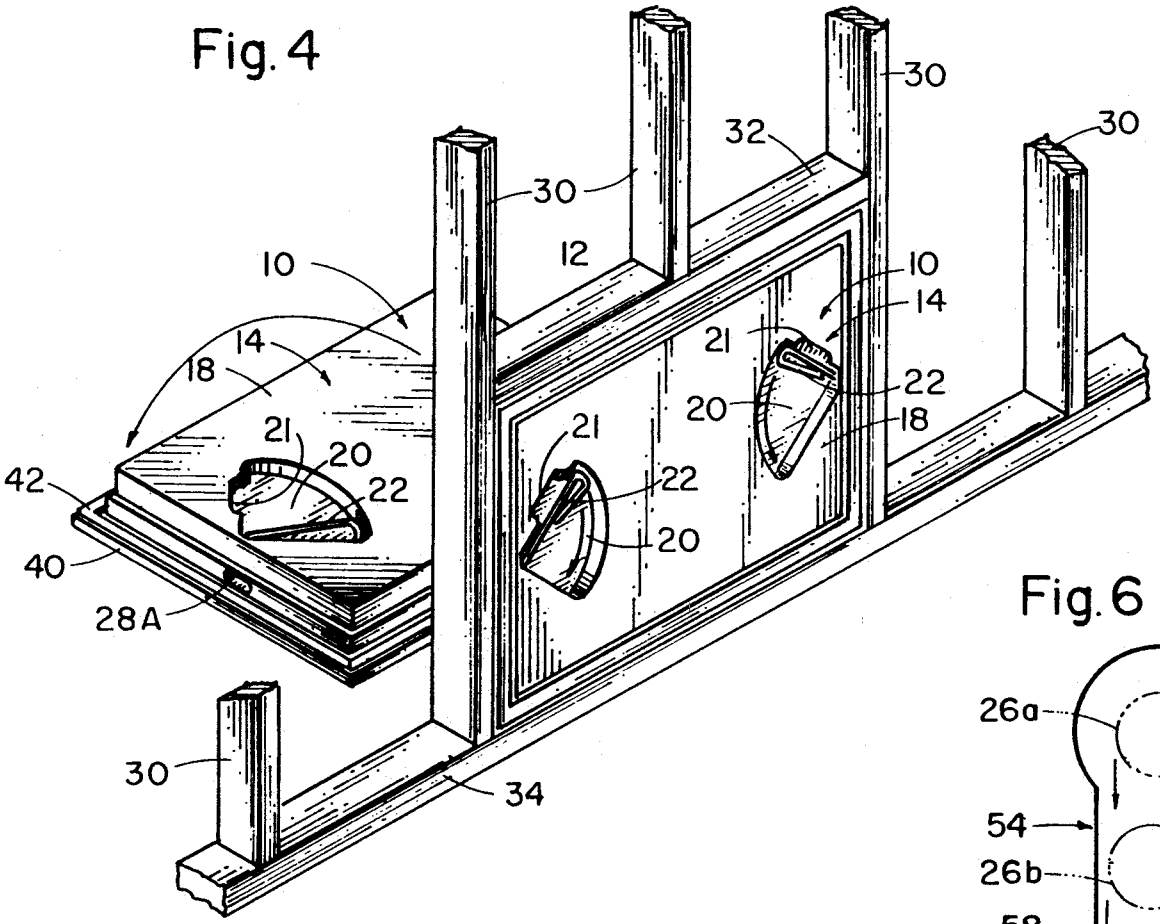
FIG. 4 is a composite perspective view showing the novel hatch in its installed and locked position and showing said hatch in its unlocked and pushed out position where it is lying in a lawn.

FIG. 4 best depicts the overall environment of the novel hatch assembly 10. As is well known, vertical studs 30 which form an exterior wall of a structure are usually spaced on sixteen inch centers and are toe-nailed into base plate 34. Note that the lowermost end of one vertical stud 30 is removed to accommodate the hatch and that a header 32 has been added to serve as a base plate for that stud. Thus, header 32, studs 30 at its opposite ends, and base plate 34 serve as a frame for frame 12. To secure frame 12 within said stud-baseplate-header frame, an adhesive material such as Liquid Nails 33 (FIG. 3) is applied with a caulking gun between frame 12 and said parts; a spacing of about three-sixteenths of an inch is provided between said parts to accommodate the adhesive.

It should therefore be understood that the novel assembly 10 can also be installed in exterior walls of mobile homes, motor homes, boats and other vehicles with mounting modifications made as needed. FIG. 4 further shows a hatch assembly 10 that has been pushed out of frame 12 by an individual inside the structure; the assembly 10 has fallen onto the ground outside the dwelling. Note that the hatch main body 14 and its frame 16 may be slidingly removed from exterior frame 12 in a single direction only, i.e., from the inside of the structure to the outside and not vice versa, as mentioned earlier.

FIG. 1 depicts, on the left side thereof, a latch handle 22 in its locked position; a latch handle in its unlocked position is depicted on the right side of said FIG. 1. Both handles must be unlocked before hatch 14 and its frame 16 can be pushed out of frame 12. Note that locking bolt 26 interconnects hatch frame 16 and exterior frame 12 when the handle 22 is in its locked position, and that no such interconnection is made when handle 22 is in its unlocked position as shown on the right side of FIG. 1 as aforesaid. More particularly, locking bolt 26 extends into opening 28A formed in frame 16 and recessed catch 28B formed in frame 12 when the hatch is locked into place. When handle 22 is rotated as shown in the right side of FIG. 1, locking bolt 26 is positioned in opening 28A only so that frame 16 can move relative to frame 12, i.e., so that the hatch can be removed to create an escape passageway.

Figure 5:
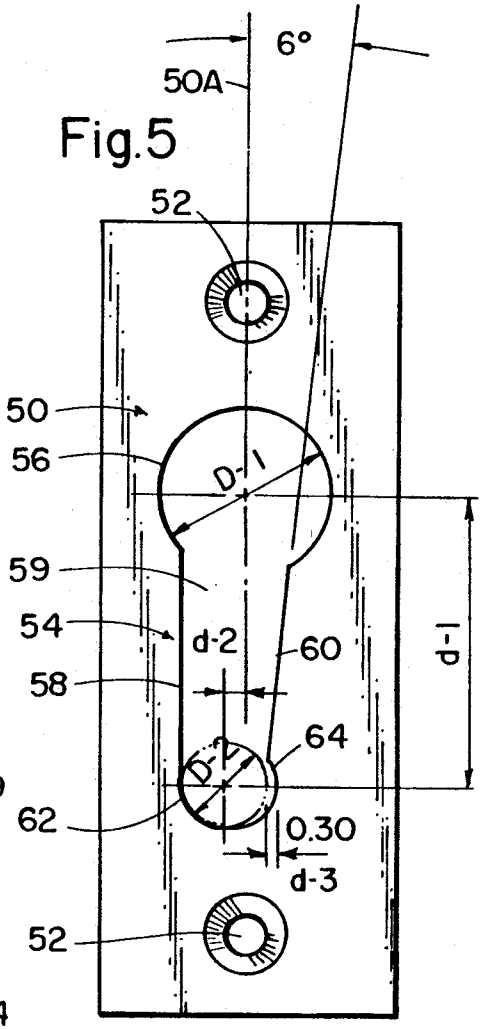

Recessed catch 28B in frame 12 is covered by a latch plate 50 (FIG. 5). The unique design of latch plate 50 facilitates the operation of unlocking the hatch in a time of emergency by a child or other individual lacking strength. Plate 50 is secured to frame 12 by screws driven into countersunk holes 52. The opening 54 formed in plate 50 has three main sections. The primary section 56 has diameter D-1 which is preferably one-half inch; the center of said primary section 56 is positioned seven-eighths of an inch, as indicated by the reference character d-1, above secondary opening 62 having diameter D-2 which is preferably one-fourth of an inch. The respective centers of circular opening 56 and circular opening 62 are laterally offset one-sixteenth of an inch, as indicated by the reference character d-2. Openings 56, 62 are interconnected by slot 59 having opposite edges 58 and 60. Edge 58 is tangent to secondary opening 62 and is parallel to the longitudinal edges of plate 50. Edge 60 is oblique to said longitudinal edges; more particularly, it is canted six degrees relative to the longitudinal axis of symmetry 50A of plate 50. Circular opening 62 is not perfectly circular; it is elongated at its horizontal axis by three-hundreds of an inch, as denoted by the reference numeral 64 and as indicated by the reference character d-3.

Figure 6:
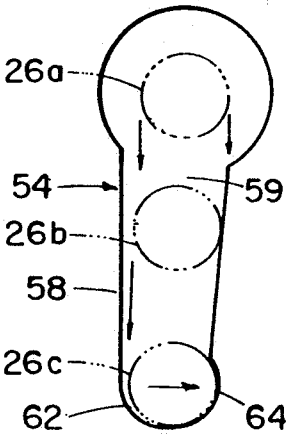
FIG. 6 is an enlarged view of the catch means and including, in phantom lines, an animation of the latch as it approaches said catch means.

The advantages derived from these precise dimensions are best appreciated in connection with FIG. 6. The round end of locking bolt 26 is shown in three successive positions in said FIGS.: 26*a*, 26*b*, and 26*c*. As handle 22 begins its pivoting about axis 24, locking bolt 26 first enters primary circular opening 56; note that said locking bolt 26 is generally centered within opening 56 at this initial part of the locking process. As the axis 24 continues to rotate, canted edge 60 of slot 59 urges the locking bolt 26 to displace away from its natural, straight down path of travel. Thus, when elongation 64 of secondary opening 62 is encountered locking bolt 26 springs into said elongation under their bias of axis 24; i.e., since axis 24 is a metal rod, its resilience will cause locking bolt 26 to enter said elongation 64 when it encounters said elongation. The bias of the axis 24 continues to hold the locking bolt 26 in the position depicted in FIG. 6 as long as no external forces are imparted against handle 22. Simultaneously, with the downward motion of the locking bolt 26, the canted edge 60 of the slot 59 also urges the hatch frame 16 to bear against the weatherstripping 42. Therefore, it is the combination of springiness of the axis 24 and the resiliency of the weatherstripping 42 that provides the locking action in the elongated hole 62. This ensures that the hatch assembly cannot fall out unintentionally even if pushed against or kicked with a large force unaccompanied by manipulation of the handles. However, the bias supplied by the axis is nominal and the depth (0.030") of elongation 64 is so nominal that a child or very weak adult can easily overcome said bias and thus unlock the hatch. The length of handle 22 provides ample leverage; the application of almost any amount of force against it will cause it to pivot about axis 24 and thus drive the locking bolt out of elongation 64 and back up edge 60 of slot 59 until it exits primary opening 56 and thus frees frame 16 from frame 12.

In this manner, an inexpensive and easy to install and operate safety device is provided. Its low positioning forces the occupants of a dwelling equipped with it to crawl out of the dwelling, thereby reducing the chances that they will be overcome by smoke. Its non-jamming features ensure that it will pop out when needed, even when the force applied to it is nominal.

It will thus be seen that the objects set forth above and those made apparent by the foregoing description are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An escape hatch assembly to facilitate emergency exiting from a structure, comprising:

a hatch main body;

an exterior frame built into the structure;

a recessed catch means formed in said exterior frame;

a latch plate disposed in overlying relation to said recessed catch means;

a hatch frame, for framing said hatch body, slideably and releasably received within said exterior frame;

a latch means for interlocking said exterior frame and said hatch frame;

said latch means being accessible from the inside only of said structure;

said hatch main body and said hatch frame being slideably removable from said exterior frame when said latch means is unlocked;

said hatch main body and said hatch frame being slideably removable from said exterior frame in a single direction only, said single direction being from inside of the structure to the outside of the structure;

said latch means including a pair of pivotally mounted latch handle means that are laterally spaced apart from one another;

each latch handle means of said pair of latch handle means including a handle, an axis, and a locking bolt;

said handle, axis, and locking bolt being integrally formed with one another and being made of a substantially rigid but flexible and resilient material;

each axis being disposed perpendicular to a plane of said main hatch body, and each handle and locking bolt being disposed parallel to said plane of said main hatch body;

said latch plate including a circular opening, a horizontally elongated opening vertically spaced downwardly from said circular opening, and an elongate slot formed therebetween, said locking bolt traveling from said circular opening to said horizontally elongated opening as a handle is rotated about its axis;

said elongate slot being canted so that as said locking bolt travels along said elongate slot from said circular opening to said horizontally elongated opening, said axis is displaced and places said locking bolt under a bias due to the resiliency of said axis;

each locking bolt being disposed in its associated catch means when its associated handle means is in an unpivoted state and said locking bolt being disposed out of its associated catch means when its associated handle means is pivoted; and each locking bolt, urged by the bias created by the resiliency of its associated axis, being disposed in its associated horizontally elongated opening when its associated latch handle is rotated about its axis, said horizontally elongated opening holding said locking bolt therein under the bias of its associated axis so that said locking bolt cannot inadvertently reenter said catch means after said handles have been pivoted.

2. The assembly of claim 1, wherein said exterior frame and hence said hatch frame are positioned in an exterior wall of said structure at a lowermost end thereof.

3. The assembly of claim 2, further comprising at least one sheet of insulation disposed interiorly of said main hatch body, and wherein said axis extends through said at least one sheet of insulation.

4. The assembly of claim 2, wherein said latch handle means is made of a metal rod, and wherein said locking bolt is angled at about one hundred thirty five degrees from said handle.

5. The assembly of claim 2, wherein said hatch main body includes an exterior wall that has a height and width greater than the height and width of an opening in said exterior wall that is framed by said exterior frame so that said hatch main body cannot be pushed into the interior of said structure from the outside of said structure.

6. The assembly of claim 5, further comprising a cut away formed in said hatch frame where it abuts said exterior frame so that said hatch frame does not become jammed against said exterior frame when the former is being removed from the latter.

7. The assembly of claim 6, further comprising a friction-reducing means disposed between said exterior frame and said hatch frame along the respective bottom edges thereof.

8. The assembly of claim 7, wherein said hatch main body includes an interior wall, wherein a pair of handle-receiving recesses are formed in said interior wall, and wherein said latch handle means are positioned within said recesses so that said latch handle means do not protrude into a room equipped with said escape hatch.

9. The assembly of claim 8, further comprising a finger-receiving recess formed in each handle-receiving recess.

10. The assembly of claim 8, wherein said handle-receiving recesses are generally wedge-shaped.

11. The assembly of claim 10, wherein said handle-receiving recesses are laterally spaced apart with respect to one another in equidistantly spaced relation to a vertical centerline of said hatch main body, on opposite sides thereof, to further ensure that the hatch main body will not jam against the exterior frame when it is removed therefrom.

* * * * *